United States Patent [19]

Phillips

[11] Patent Number: 4,919,280

[45] Date of Patent: Apr. 24, 1990

[54] MERCHANDISING SYSTEM

[75] Inventor: Kenneth A. Phillips, Warwick, R.I.

[73] Assignee: American Tourister, Inc., Warren, R.I.

[21] Appl. No.: 299,129

[22] Filed: Jan. 23, 1989

[51] Int. Cl.[5] ..... A47F 5/08

[52] U.S. Cl. ..... 211/87; 211/187

[58] Field of Search ..... 211/87, 187, 88, 90, 211/50

[56] References Cited

U.S. PATENT DOCUMENTS

| | | | |
|---|---|---|---|
| 2,538,958 | 1/1951 | Augenfeld | 211/90 X |
| 2,944,863 | 7/1960 | Bertelsen | 211/90 X |
| 3,080,980 | 3/1963 | Gibbons | 211/187 X |
| 3,179,257 | 4/1965 | Tassell | 211/187 X |
| 3,993,002 | 11/1976 | Stroh | 211/90 X |
| 4,548,327 | 10/1985 | Kilkelly | 211/187 |
| 4,697,712 | 10/1987 | Valiulis | 211/187 |
| 4,735,325 | 4/1988 | Remmers | 211/187 |

OTHER PUBLICATIONS

Alpha Catalog 6-87, Powercast, Lourvre Grid, 3 pages.
Alpha Catalog, Powercast, Modular Fixturing, 2 pages.

*Primary Examiner*—Alvin C. Chin-Shue
*Assistant Examiner*—Sarah A. Lechok
*Attorney, Agent, or Firm*—Herron & Evans

[57] ABSTRACT

A merchandising system wherein vertically spaced horizontal brackets are secured to a long wall. Vertical poles are spaced horizontally from the walls to divide the area into multiple sections, two adjacent vertical poles defining a section. The poles have shelf corner supports which, cooperating with the brackets, provide for the mounting of shelves. Other sections are provided with vertical wire grids whereby the system accommodates standup luggage on the shelves and hang-up luggage on the wire grids.

4 Claims, 3 Drawing Sheets

MERCHANDISING SYSTEM

This invention relates to a merchandising system, and more particularly, the invention relates to a variable display arrangement principally for luggage, although obviously it could be suitable for other types of merchandise.

BACKGROUND OF THE INVENTION

Referring to the matter of merchandising of luggage, it is contemplated that a manufacturer of luggage would sell some of its product at outlet stores. Complete walls of the outlet store, 60–70 feet long, would be devoted to the display of luggage. It is of course desired to display the luggage as attractively and as visibly as possible and to be able to change the displays from time to time as the product mix changes. But there are currently marketed no display systems which admit of variable arrangements and rearrangements while remaining attractive. Adjustable shelving is, of course, available. For the most part, such shelving creates a kind of warehouse ambiance that is not suitable for the merchandising of luggage. Other shelving does not permit the displaying of merchandise such as luggage in such a manner that it can be seen by the prospective purchaser. Still other display systems are suitable for providing an attractive presentation of merchandise but are designed only for garments.

SUMMARY OF THE INVENTION

It has been an objective of the present invention to provide a merchandising system that admits of a display of a great many pieces of diverse types of luggage in an attractive setting and one which is susceptible of rearrangements to accommodate different product mixes.

The objective of the present invention is attained by structure that is suitable for erection along a long wall and which divides the wall into a number of sections, the sections being, for example, approximately 7½ feet wide. The system provides for horizontal L-shaped brackets to extend along the length of the wall, usually 3–4 vertically spaced lines of brackets being provided. Brackets provide support for the rear edge of each shelf positioned in a section. The brackets have riveted thereto projecting hangers for supporting a wire grid.

Spaced from the wall are a plurality of poles, the poles having flanges by which they are secured to the wall and floor. The walls are horizontally spaced apart a sufficient distance to define multiple sections, the distance between poles in the illustrated embodiment being 7½ feet. The poles receive vertical slidable cross fittings. Each fitting has a vertical cylinder by which it is adjustably mounted on the pole. It also has a horizontal cylinder which receives a horizontal sleeve having projecting ends. The sleeve for each projecting end has a 90° arcuate portion removed from it to present two edges against which the corner of a shelf nests. The shelves thus rest on brackets at the rear edge and sleeves at the front edge. The fittings may be raised and lowered and fixed in the position to which they are adjusted, thereby enabling the shelves to be placed in a horizontal attitude or in an inclined attitude wherein the luggage is more easily viewed by the customer.

The invention also contemplates the provision of a fluorescent light across the rear edge of at least one of the shelves as, for example, the middle shelf of three in a display. The fluorescent light, being exposed above and below the shelf, provides an attractive back lighting which enhances the attractiveness of the display and provides the customer with a better view of the luggage in the display. This feature is particularly important where the luggage is dark.

It is also contemplated that hooks be riveted to and project perpendicularly from the angle brackets. A wire grid is mounted to the hooks in place of the shelves in selected sections. The wire grid is preferable for luggage that can only be displayed by hanging while using the shelves for the standup type luggage. The projecting hooks have no function where shelves are seated on the angle brackets, but are available in all sections to permit the rearrangement of the shelves and grids as the product mix changes.

DETAILED DESCRIPTION OF THE INVENTION

Figure 1:
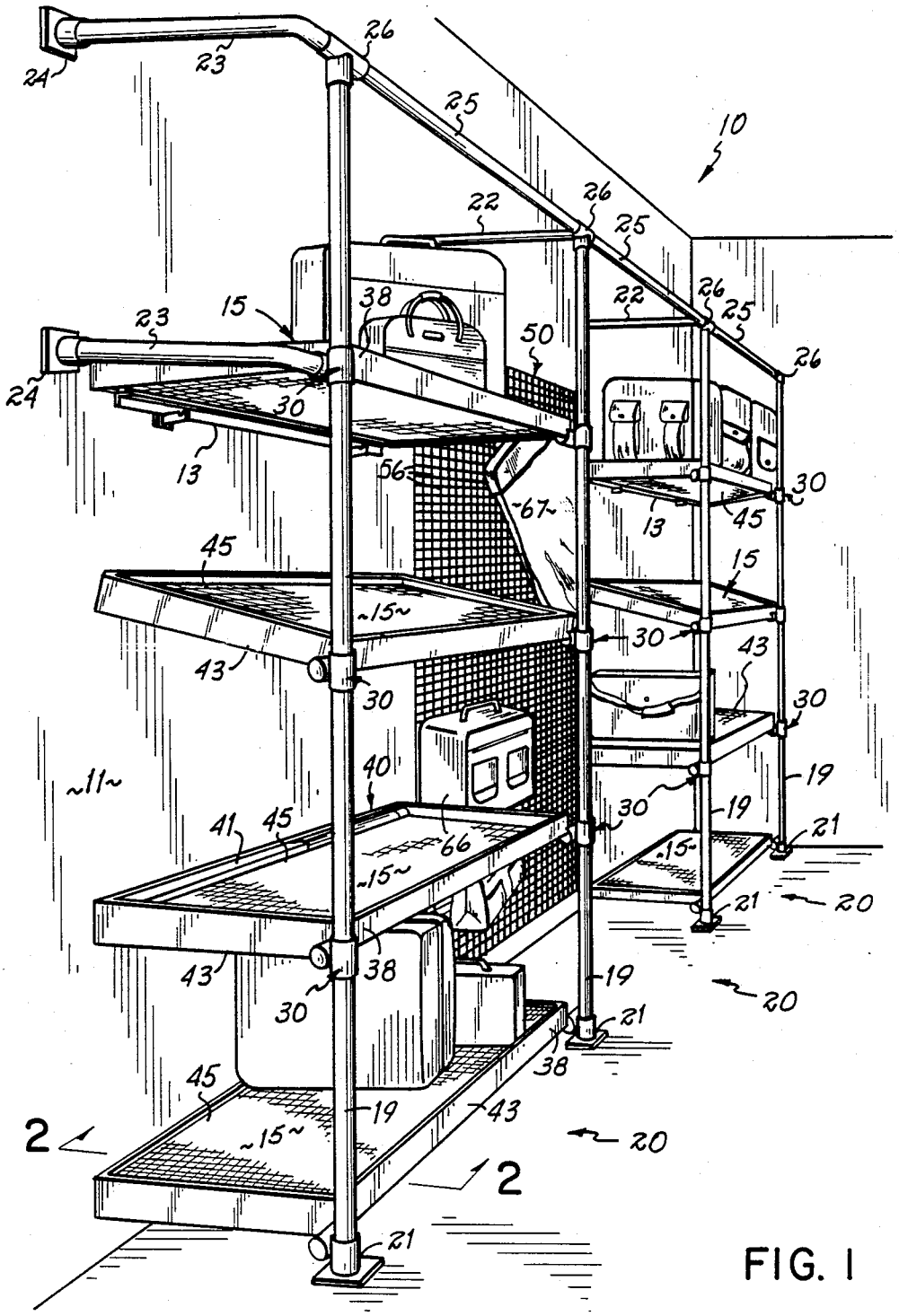
FIG. 1 is a perspective view of the invention.

Referring to FIG. 1, a merchandising system 10 includes an elongated wall 11 forming part of a room in which the merchandise is displayed and sold. Horizontal angle brackets 13 are mounted on the wall. The angle brackets are vertically spaced to provide rear edge supports for three shelves 15. At each level, the brackets extend horizontally in a line throughout the extent of the wall area dedicated to merchandising display. For example, a 70 foot wall might have approximately 65 feet dedicated to display. In the case of the illustrated embodiment, each level of brackets would contain seven brackets end-to-end suitable for accommodating seven shelves. A plurality of vertical poles 19 are horizontally spaced from each other, each pair of poles defining, with the opposed angle brackets, a 7½ foot section 20. Lower ends of the vertical poles have flanges 21 by which the poles are anchored, with screws, to the floor. Transverse tubes 22 connect the tops of the poles 19 to the wall 11. At each end of the display, L-shaped tubes 23 anchor the endmost poles 19 to the wall 11, suitable flanges 24 being provided at the end of the tubes 23 for securing the tubes to the wall. Horizontal tubes 25 are connected end-to-end between the upper ends of the poles 19 for lateral stability. Cross-ell fittings 26 join together the horizontal tubes 25, the tubes 22, 23 projecting from the walls and the poles 19.

Figure 2:
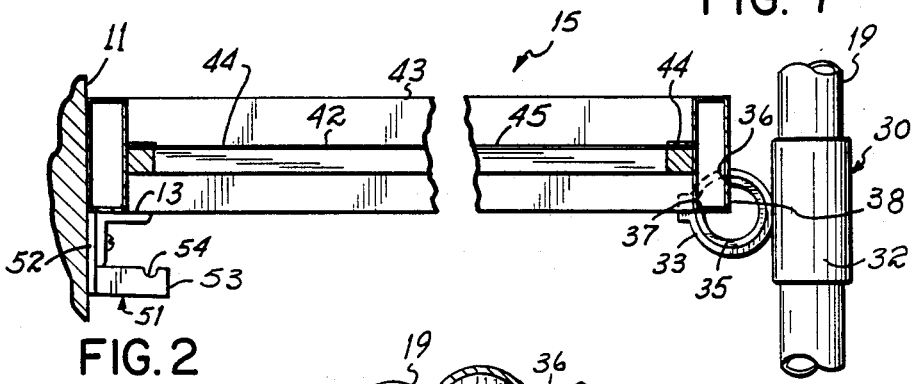
FIG. 2 is a cross-sectional view taken along lines 2—2 of FIG. 1.
Figure 3:
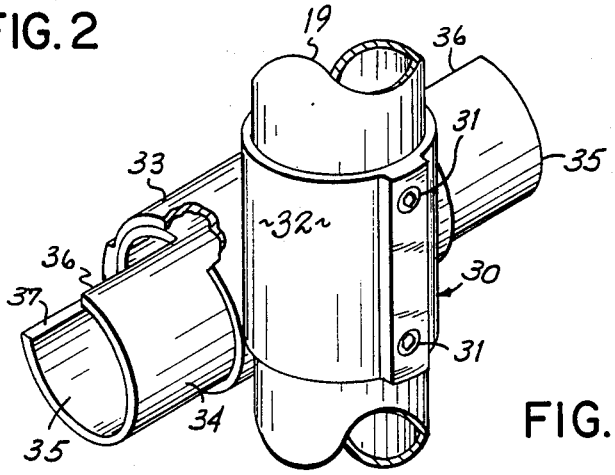
FIG. 3 is a fragmentary perspective view of a shelf corner mount.

Intermediate the upper and lower ends of the poles 19 are three cross fittings 30 which are slidably mounted on the poles. Each fitting can be set in a selected position by set screws 31 (FIG. 3). Each cross fitting 30 has a vertical cylinder 32 which receives the pole 19. Each cross fitting 30 has a horizontal cylinder 33 that receives a sleeve 34 which can also be fixed in its position in its cylinder 33 by means of set screws (not shown). Each sleeve 34 has one or two projecting portions 35 from which an arcuate portion has been removed to present two edges 36 and 37. One edge 36 is vertically oriented and one edge 37 is horizontally oriented (FIG. 2). Those edges each receive a corner 38 of a shelf 15, thereby supporting the front edge of each shelf. As can be seen in FIG. 1, the adjustability of the fittings 30 permits shelves normally in a horizontal attitude to be adjusted to a downwardly-inclined attitude as shown by the middle shelf of FIG. 1. In the downwardly-inclined attitude, the merchandise is more easily viewed and can be more easily lifted off the shelf.

Figure 6:
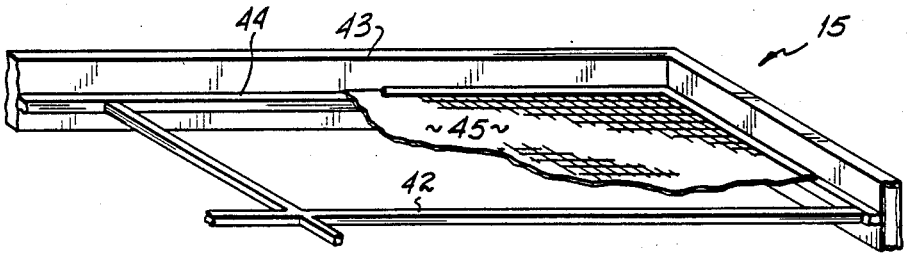
FIG. 6 is a perspective view of a shelf.

Preferably, each shelf 15 is formed as shown in FIG. 6. 1"×3" tubing 42 is used to form a rectangular frame outlining the shelf. Half-inch square tubing 42 is fixed, as by welding, to the inside surface of the frame 43 to form a support 44. A perforated sheet 45 is disposed on top of the support.

Figure 7:
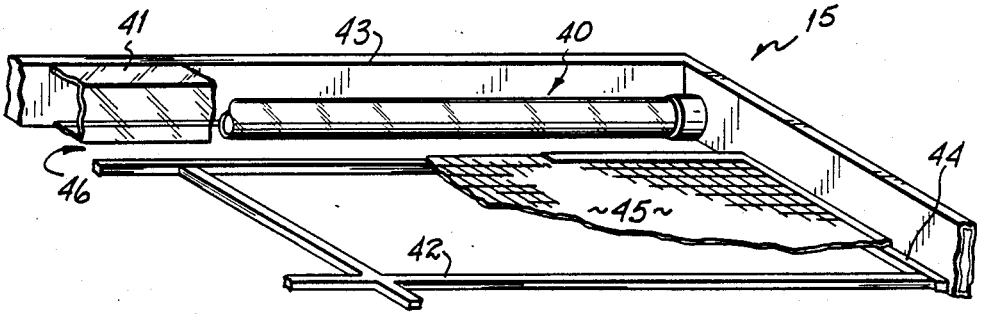
FIG. 7 is a perspective view of a shelf partially in cross section provided with a fluorescent fixture.

One or more of the shelves as shown in FIG. 7 may be provided with a fluorescent fixture 40 protected above and below by a transparent lens 41 which permits its light to be directed upwardly and downwardly. When the shelf is to receive a fluorescent bulb, the sheet 45 and support 44 are made narrow to leave a gap 46 into which the fluorescent bulb is placed. The fluorescent fixture 40 provides for the back lighting of the luggage on the shelf that has the fluorescent bulb as well as the shelf below it.

Figure 5:
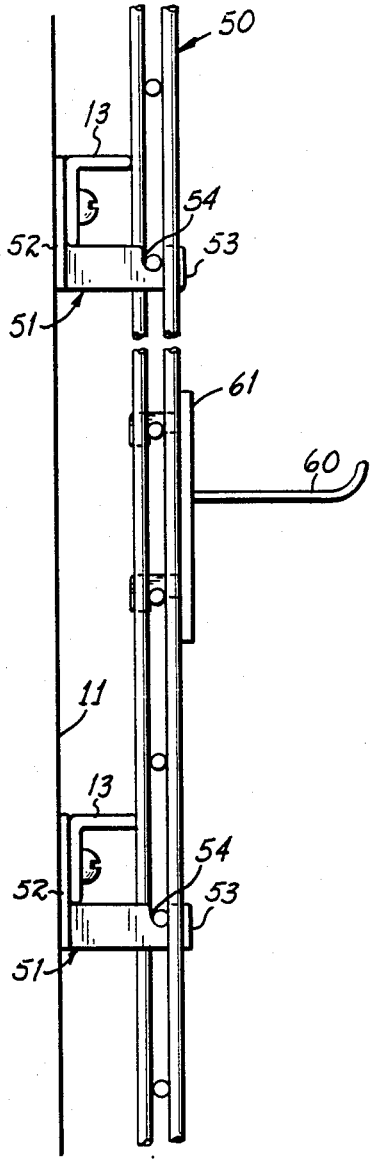
FIG. 5 is a fragmentary side elevational view of the wire grid and mount therefor.
Figure 4:
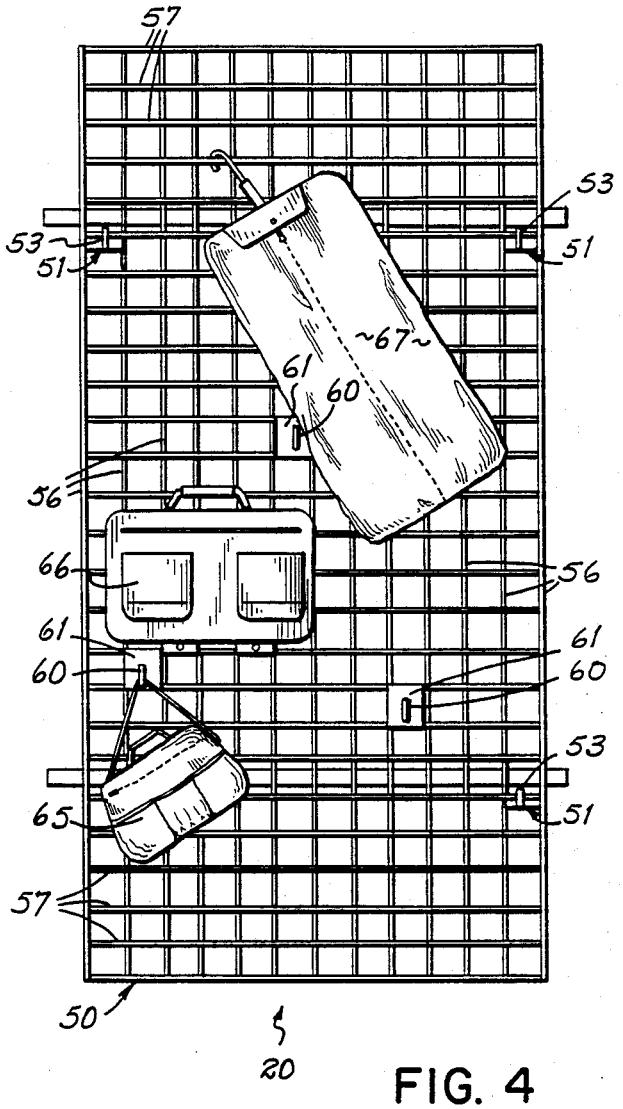
FIG. 4 is an elevational view of the wire grid and mount therefor.

Each section 20 optionally may be provided with a wire grid 50. The wire grid 50 is supported on hangers (FIGS. 4 and 5); each hanger has a flange 52 which is riveted to an angle bracket 13. An arm 53 projects from the flange 52. The arm 53 has a recess 54. Each wire grid 50 is formed of vertical rods 56 and horizontal rods 57. The slots 54 in the arms 53 receive the horizontal rods 57 to support the grid in a position slightly spaced from the wall. Hooks 60, each having a flange 61, are adapted to hook over horizontal rods 57 to receive and support articles of merchandise such as bags 65, 66 and 67 shown in FIG. 4.

From the foregoing, it can be seen that the modular system of the present invention provides an exceptionally attractive luggage display system. The basic structure consists of the horizontal shelf angle brackets that support the rear edge of the shelves. The vertical poles have fittings which are adjustable and even removable if that is desired. The fittings provide for the receipt of the horizontal sleeves by which the front edges of the shelves 15 are supported. In the middle of the display, the shelves project from both sides of the fittings to support shelves on both sides of a pole. At the ends of the display, the sleeve has only one slotted end to project from the side of the fitting to support the corner of one shelf. The poles divide merchandising into sections 20 and those sections can be devoted to shelves with standup luggage, wire grids with hanging luggage or combinations of the two using short sections of wire grid. All of this is accomplished by a small number of parts including the brackets, the fittings, the sleeves, the shelves, the poles and the wire grids.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A merchandising system comprising, a wall, a first set of a plurality of brackets mounted on said wall in vertically spaced relation, each said bracket having a horizontally projecting leg, at least two vertical poles spaced from said wall and opposite said brackets, a plurality of cross fittings mounted on each of said poles, each said cross fitting having a horizontal cylinder, each said bracket having a pair of said cross fittings opposite each said bracket, cylindrical horizontal sleeves in the cylinders of said cross fittings, said sleeves having slotted projecting portions, and a shelf having a front edge mounted in each pair of said slotted portions of said sleeves and a back edge mounted on each said bracket.

2. A display system as in claim 1 further comprising, a light mounted in at least one of said shelves adjacent its rear edge to provide backlighting against said wall.

3. A display system as in claim 2 in which said light shines above and below said shelf.

4. In a display rack, a corner mount for a shelf comprising, at least one vertical pole, a two-cylinder right angle fitting having one cylinder mounted on said pole, the other cylinder having a horizontal axis, a sleeve fixed in the other cylinder, said sleeve having at least one end projecting from its cylinder, said end being a partial cylinder presenting two arcuately spaced edges, the corner of said shelf being placed between said spaced edges.

* * * * *